US011617398B1

(12) United States Patent
Castiblanco et al.

(10) Patent No.: US 11,617,398 B1
(45) Date of Patent: Apr. 4, 2023

(54) BRASSIERE HAVING UNDERARM CONTROL PANELS

(71) Applicants: Jose Adelfo Castiblanco, Bogota D.C. (CO); Jose Luis Castiblanco, Bogota D.C. (CO)

(72) Inventors: Jose Adelfo Castiblanco, Bogota D.C. (CO); Jose Luis Castiblanco, Bogota D.C. (CO)

( * ) Notice: Subject to any disclaimer, the term of this patent is extended or adjusted under 35 U.S.C. 154(b) by 91 days.

(21) Appl. No.: 17/066,626

(22) Filed: Oct. 9, 2020

(51) Int. Cl.
*A41C 3/00* (2006.01)

(52) U.S. Cl.
CPC ..... *A41C 3/0021* (2013.01)

(58) Field of Classification Search
None
See application file for complete search history.

(56) References Cited

U.S. PATENT DOCUMENTS 2,713,683 A * 7/1955 Krieger ..... A41C 3/00 450/74
2,782,416 A * 2/1957 Ginsburg ..... A41C 3/148 450/55
3,411,509 A * 11/1968 Sachs ..... A41C 3/00 450/120
3,628,539 A * 12/1971 Fredricks ..... A41C 3/148 450/86
3,699,971 A * 10/1972 Hittel ..... A41C 3/0028 450/67
3,746,008 A * 7/1973 LoCascio ..... A41C 3/00 450/74
3,896,818 A * 7/1975 Locascio ..... A41C 3/00 450/72
4,154,249 A 5/1979 Darring
D254,937 S 5/1980 Raimondi
4,254,777 A * 3/1981 Johnston ..... A41C 3/0057 450/41
D265,265 S * 7/1982 Stern ..... D2/710
4,655,224 A * 4/1987 Stern ..... A41C 3/00 450/67
D388,587 S 1/1998 Magidson et al.
6,165,045 A 12/2000 Miller et al.
6,439,959 B1 8/2002 Magrone et al.
6,790,122 B2 * 9/2004 Mitchell ..... A41C 5/00 450/75
7,588,479 B2 9/2009 Falla
7,614,256 B2 11/2009 Mitchell
8,038,506 B2 10/2011 Allen et al.
8,328,598 B2 * 12/2012 Smith ..... A41C 5/00 450/45
9,717,284 B2 * 8/2017 Misseldine ..... A41C 3/0007
10,448,679 B1 10/2019 Roddis et al.
(Continued)

FOREIGN PATENT DOCUMENTS

WO 2018078673 A1 5/2018
WO 2018193270 A1 10/2018

*Primary Examiner* — Jocelyn Bravo
(74) *Attorney, Agent, or Firm* — Albert Bordas P.A.

(57) ABSTRACT

A brassiere having a cup section with first and second cups, first and second control panels, a bottom band, a back panel assembly, and first and second strips, wherein the brassiere is made of a knitted stretch fabric that shapes and smoothes the back and underarms of a user. The first and second control panels support flesh under the arms of the user, eliminating overhang of the flesh. The back panel assembly has a high back design.

7 Claims, 5 Drawing Sheets

(56) References Cited

U.S. PATENT DOCUMENTS

| | | | | |
|---|---|---|---|---|
| 11,044,954 | B2 * | 6/2021 | Misseldine | A41C 3/0057 |
| 2010/0015886 | A1 * | 1/2010 | Waitz | A41C 3/10<br>450/86 |
| 2011/0086577 | A1 | 4/2011 | Edythe et al. | |
| 2011/0300774 | A1 * | 12/2011 | Smith | A41C 5/00<br>112/475.09 |
| 2012/0164915 | A1 * | 6/2012 | Yuasa | A41C 3/0021<br>450/70 |
| 2014/0162531 | A1 * | 6/2014 | Mazourik | A41C 3/0071<br>450/86 |
| 2014/0256222 | A1 * | 9/2014 | Silver | A41C 3/0057<br>450/58 |
| 2015/0272232 | A1 * | 10/2015 | Misseldine | A41C 3/0007<br>450/52 |
| 2016/0044972 | A1 * | 2/2016 | Yuasa | A41C 3/12<br>450/52 |
| 2017/0340023 | A1 | 11/2017 | McKeen et al. | |
| 2020/0120994 | A1 * | 4/2020 | Sanchez | A41C 3/124 |
| 2021/0106075 | A1 * | 4/2021 | Misseldine | A41C 3/0021 |
| 2021/0186125 | A1 * | 6/2021 | Lee | A41C 3/0028 |

* cited by examiner

BRASSIERE HAVING UNDERARM CONTROL PANELS

BACKGROUND OF THE INVENTION

1. Field of the Invention

The present invention relates to brassieres, and more particularly, to brassieres for molding a user's shape.

2. Description of the Related Art

Applicant believes that one of the closest references corresponds to U.S. Pat. No. 9,717,284 B2 issued to Jeanette Misseldine, on Aug. 1, 2017 for Brassiere. However, it differs from the present invention because Misseldine teaches a brassiere comprising a wing having a top edge and a bottom edge, at least one strap and at least one cup for receiving a breast, the cup having an around cup edge section, an underarm edge section, a neckline edge section and an apex, the around cup section of the cup having a wire, wherein the brassiere further comprises a control panel generally extending from the apex of the cup into the wing, the control panel having an upper edge and a lower edge and wherein the wire terminates proximal to the lower edge of the control panel.

Applicant believes that another reference corresponds to U.S. Pat. No. 8,038,506 B2 issued to Allen, et al. on Oct. 18, 2011 for Brassiere with improved side panel construction. However, it differs from the present invention because Allen, et al. teach a brassiere having flexibility, durability, and improved comfort for the wearer. The side panel of the bra comprises a folded fabric and two elastic bands. The folded fabric has two opposing longitudinal edges, a top edge, and a bottom edge. Each of the two elastic bands is positioned in the interior of the folded fabric along a respective longitudinal edge, which also includes notches for orienting the bands. The folded fabric is sewn together at each of the top and bottom edges such that the two elastic bands are held in place. One of the longitudinal edges may be formed by sewing the folded fabric together to form a seam using a pull-out stitch. Each of the two elastic bands may include either of a woven elastic band or a knitted elastic band.

Applicant believes that another reference corresponds to U.S. Pat. No. 6,439,959 B1 issued to Magrone, et al. on Aug. 27, 2002 for Wireless support for brassiere. However, it differs from the present invention because Magrone, et al. teach a wireless support system that comprises a three-dimensional frame having a sling section and a lower frame section. The sling section and lower frame section may be separate pieces that are sewn together in the three-dimensional shape, or they may be one piece that is molded into the desired three-dimensional shape. The lower frame is provided between the underarm areas and fits underneath the breasts. The sling portion comprises two-cup portions and two extending arms that reach into the straps of the brassiere to provide lift and support to the breasts. The frame is preferably sewn into the interior of a brassiere between an outer material of the brassiere and an inner material of the brassiere that resides against the wearer's skin.

Applicant believes that another reference corresponds to U.S. Pat. No. 7,588,479 B2 issued to Falla on Sep. 15, 2009 for Front closure brassiere having dynamic adjustable section. However, it differs from the present invention because Falla teaches a brassiere having a front opening and a dynamic adjustable back section, and a first side panel and a second side panel. The brassiere also has a pair of breast receiving cups and a connector between the breast receiving cups for selectively opening and selectively closing the brassiere. The dynamic adjustable back section elongates from a first length to a second length to automatically adjust a size of the brassiere.

Applicant believes that another reference corresponds to U.S. Pat. No. 7,614,256 B2 issued to John Mitchell on Nov. 10, 2009 for Back supporting brassiere and undergarments with reinforced zones and method of making the same. However, it differs from the present invention because Mitchell teaches a circular knit brassiere. The brassiere has a back panel, a front panel preferably having a pair of breast cups, and preferably having a pair of shoulder straps. The back panel has at least one reinforced zone. The breast cups, shoulder straps, and the central gore also have reinforced zones. The reinforce zones are formed during the knitting process, and also using positive float miss stitch construction combinations and added in yarns. The brassiere also has true or mock terry stitch construction on the wearer facing fabric side of the reinforced zones, for providing moisture wicking properties. The reinforced zones can also be knitted into garments such as shapewear, maternity wear, and athletic wear.

Applicant believes that another reference corresponds to U.S. Pat. No. 3,746,008 A issued to LoCascio, et al. on Jul. 17, 1973 for Brassiere. However, it differs from the present invention because LoCascio, et al. teach a brassiere, having first and second breast cups joined to one another and first and second dorsal panels joined to the first and second breast cups respectively, with each of the first and second dorsal panels comprising a first segment consisting of material having at least one-way stretch characteristics oriented substantially in a horizontal direction when the brassiere is worn by the wearer, and a second segment joined to the first segment and to the outer side edge of the respective one of the breast cups, with the second segment of each dorsal panel consisting of material having primary stretch characteristics in one direction angularly oriented with respect to the said horizontal direction. With this arrangement, the first segment of the dorsal panels are principally subjected to tension when the brassiere is placed on the body of the wearer, and the horizontal tensile forces are channeled to the lowermost region of the first segment of the dorsal panel. When the arms are lifted, the distensible second segments of the dorsal panel are available to accommodate the ensuing body movements. The second segment of each dorsal panel cooperates with the selectively oriented stretch characteristics of a portion of the center arrangement which joins the breast cups to one another to permit relatively independent action of each breast cup in response to movement of one or both of the woman's arms.

Applicant believes that another reference corresponds to U.S. Pat. No. 6,165,045 A issued to Miller, et al. on Dec. 26, 2000 for Brassiere. However, it differs from the present invention because Miller, et al. teach a bra for large breasted women having a pair of molded cups, each of which is mounted in a non-stretchable harness member that encircles the breast giving it firm support. Also attached to the harness member is a soft, stretchable cloth cover. The cover both enhances the appearance of the bra and provides additional support for the breast. The two harness members, which are generally mirror images of each other, are removably fastened together in the front by a heavy duty zipper. Each individual harness member is supported by three straps, which encircle the user's body. Among these straps are an elastic waistband, a wide shoulder strap of adjustable length, and an underarm strap. The underarm and shoulder straps are joined to the harness member at points distal from the zipper and proximate with the upper and lower edges, respectively, of the molded cup mounted in the harness member. The two pairs of shoulder and underarm straps are connected together, forming a yoke, in the center of the back. The first insert is located within the harness member itself between the shoulder and underarm strap attachment points and the second insert in the otherwise non-stretchable underarm strap.

Applicant believes that another reference corresponds to U.S. Pat. No. 10,448,679 B1 issued to Roddis, et al. on Oct. 22, 2019 for High impact and high support bras. However, it differs from the present invention because Roddis, et al. teach a bra that comprises a band that wraps around a torso. The band has first and second cup regions, and a channel that runs below the collective cup regions. A gore is formed above the channel and between the respective cup regions, adjoining the respective cup regions. A molded cradle is fitted into the channel. For each cup region, a tessellated encapsulating bra cup is fitted therein. Each tessellated encapsulating bra cup includes a plurality of tiles. Respective tiles in the plurality of tiles that are further away from the cradle are larger in size than respective tiles in the plurality of tiles that are closer to the cradle. Each tessellated encapsulating bra cup has a generally concave first inner face and a generally convex first outer face. The tessellated encapsulating bra cups collectively contribute cantilevered support to the bra.

Applicant believes that another reference corresponds to U.S. Pat. No. 4,154,249 A issued to Violet Darring on May 15, 1979 for Midriff controlling undergarment. However, it differs from the present invention because Darring teaches a midriff controlling undergarment that has an upper torso encircling portion and a lower torso encircling pants portion releasably connected together at a parting plane located approximately at the waist of the user. A plurality of circumferentially spaced apart snaps are on the adjacent edges of the upper and lower portions, releasably joining them together in overlapping relationship to shape and control the waist of the user and prevent midriff bulge. The snaps enable easy, one-hand attachment and release of the two portions, thus facilitating use by obese persons or persons suffering from other infirmities, such as blindness and the like.

Applicant believes that another reference corresponds to U.S. Patent Application Publication No. 2017/0340023 A1, published on Nov. 30, 2017 to McKeen, et al. for Garment Support Structure and Casing. However, it differs from the present invention because McKeen, et al. teach a garment, such as a bra, that has a frame, a support structure, and a casing and/or housing. The frame may be adapted to fit underneath a wearer's breasts and partially wrap around her torso. The support structure be coupled to the frame and may include a volumetric cup positioned thereon, which may be a cantilever projection from the frame adapted so that a portion of a wearer's breasts may be inserted therein. The frame and/or support structure may be encased in a casing. Casing may increase the size of volumetric cup to cover a larger portion of the wearer's breast. Casing may also provide padding or other mechanisms to increase the comfort of wearing the frame, support structure, and/or casing for the wearer. The casings may be housed in a housing that wraps around the wearer's torso thereby enabling the wearer to wear the garment.

Applicant believes that another reference corresponds to U.S. Patent Application Publication No. 2011/0086577 A1, published on Apr. 14, 2011 to Edythe, et al. for Post-surgery bra. However, it differs from the present invention because Edythe, et al. teach a bra for use by a patient after breast surgery. The bra has an inner lining, an outer decorative layer, and a partial cup portion disposed between the layers. The partial cup portion is made of a molded foam, and does not extend above the apex of the cup position of the bra. Thus, the bra helps prevent irritation of sore areas and remains cooler over the upper cup area. A pocket is provided on the inner portion of the cup area for a prosthesis. Ideally, a wide lower band is provided to help hold the bra in place, and for comfort.

Applicant believes that another reference corresponds to WO Patent Application Publication No. 2018/193270 A1, published on Oct. 25, 2018 to Jeanette Misseldine for Brassiere. However, it differs from the present invention because Misseldine teaches a brassiere for fuller figured and plus size women, and more particularly to brassieres for fuller figured and plus size women to wear during sporting activities. The brassiere comprises a cradle, two straps and two cups each for receiving a breast, each of the cups having an around cup edge section, an underarm edge section, a neckline edge section, a center edge section and an apex, wherein the brassiere further comprises a Y shaped control panel generally extending from the straps across the top of the neckline edge section of each of the cups and down the center edge section of each of the cups to the cradle.

Applicant believes that another reference corresponds to WO Patent Application Publication No. 2018/078673 A1, published on May 5, 2018 to Hirakubo Akiyo for Women's Underwear. However, it differs from the present invention because Akiyo teaches a brassiere by which it is possible, without wires, and without the cups slipping upward, to naturally push up a bust that is inclined toward the stomach and to create a beautiful decolletage without deformation at the neckline.

Applicant believes that another reference corresponds to U.S. Patent No. D388,587 issued to Magidson, et al. on Jan. 6, 1998 for Brassiere. However, it differs from the present invention because Magidson, et al. teach an ornamental design for a different brassiere.

Applicant believes that another reference corresponds to U.S. Pat. No. D254,937 issued to Raimondi on May 13, 1980 for Brassiere. However, it differs from the present invention because Raimondi teaches an ornamental design for a different brassiere.

Other patents describing the closest subject matter provide for a number of more or less complicated features that fail to solve the problem in an efficient and economical way. None of these patents suggest the novel features of the present invention.

SUMMARY OF THE INVENTION

The present invention is a brassiere comprising a cup section having first and second cups, first and second control panels, a bottom band, a back panel assembly, and first and second straps, whereby the brassiere is made of a knitted stretch fabric.

The first and second cups each comprise a lateral edge, a neckline, and a cup base. The cup section further comprises first and second padding inserts. The first and second control panels each comprise an underarm edge, a lower edge, a back edge, a neckline edge, and a strap edge. The bottom band comprises a band having an elastic strip and is defined by first and second cup edges, first and second band lateral edges, a bottom edge, and upper edges, whereby the elastic strip extends from the bottom edge.

The back panel assembly comprises first and second panels, first and second wings, and back elastic strips. The first and second panels each comprise a band upper edge, a back panel lateral edge, an interior edge, and a panel bottom edge. The back panel assembly further comprises an eyelet band having a plurality of eyelets and a hook strip having a plurality of hooks.

The first and second wings comprise first and second wing upper edges respectively and first and second wing bottom edges respectively.

The first and second control panels are attached to the first and second cups respectively, whereby each of the lower edges is attached to each of the lateral edges respectively. The first and second control panels are attached to the bottom band whereby each of the lower edges is attached to a respective the upper edge. The first and second control panels are attached to the back panel assembly, whereby each of the back edges are attached to a respective the interior edge. The underarm edges align with a respective the band upper edge.

The first and second cups are attached to the bottom band whereby the first and second cup edges receive the first and second cup bases respectively. The first and second straps extend from the first and second control panels respectively to the first and second panel respectively. The bottom band is attached to the back panel assembly, whereby the elastic strip and the back elastic strips align. The hook strip is attached to the first wing and the eyelet band is attached to the second wing, whereby a hook strip top edge aligns with the first wing upper edge and an eyelet band top edge aligns with the second wing upper edge. The first and second panels are attached to the first and second wings, whereby sections of the first and second back panel lateral edges extend from the first and second wing upper edges respectively defining L-shapes. The first and second control panels contain flesh and eliminate overhang of the flesh. The back panel assembly comprises a high back design.

It is therefore one of the main objects of the present invention to provide a brassiere that shapes and smoothes the back and underarms of a use.

It is another object of this invention to provide a brassiere having a high back design.

It is another object of this invention to provide a brassiere that is elastic, mark free, and wireless.

It is another object of this invention to provide a brassiere, which is of a durable and reliable construction.

It is yet another object of this invention to provide a brassiere that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
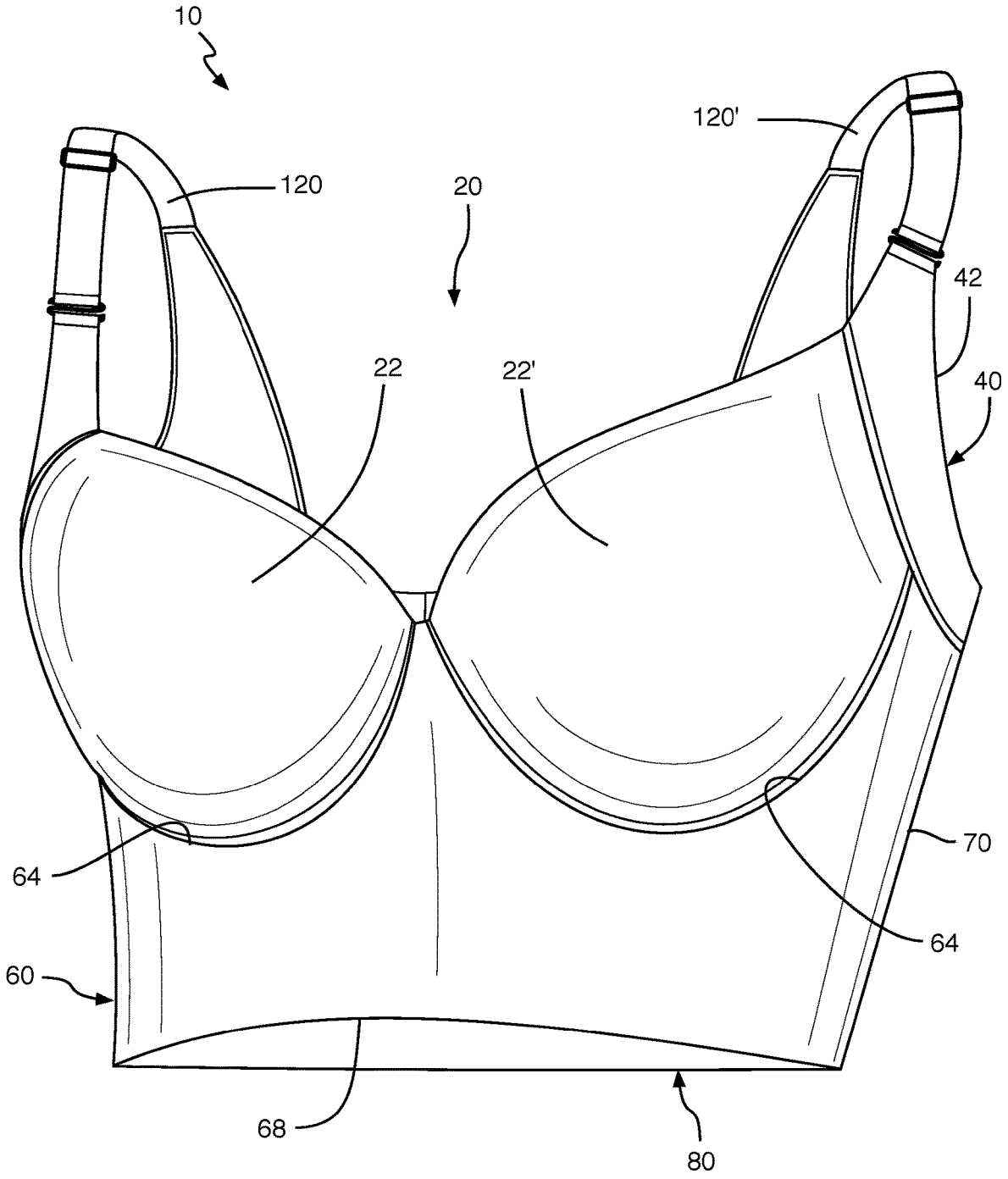
FIG. 1 is a front isometric view of the present invention.

Referring now to the drawings, the present invention is a brassiere, and is generally referred to with numeral 10. It can be observed that it basically includes cup section 20, first and second control panels 40 and 40', bottom band 60, back panel assembly 80, and first and second straps 120 and 120'.

Figure 2:
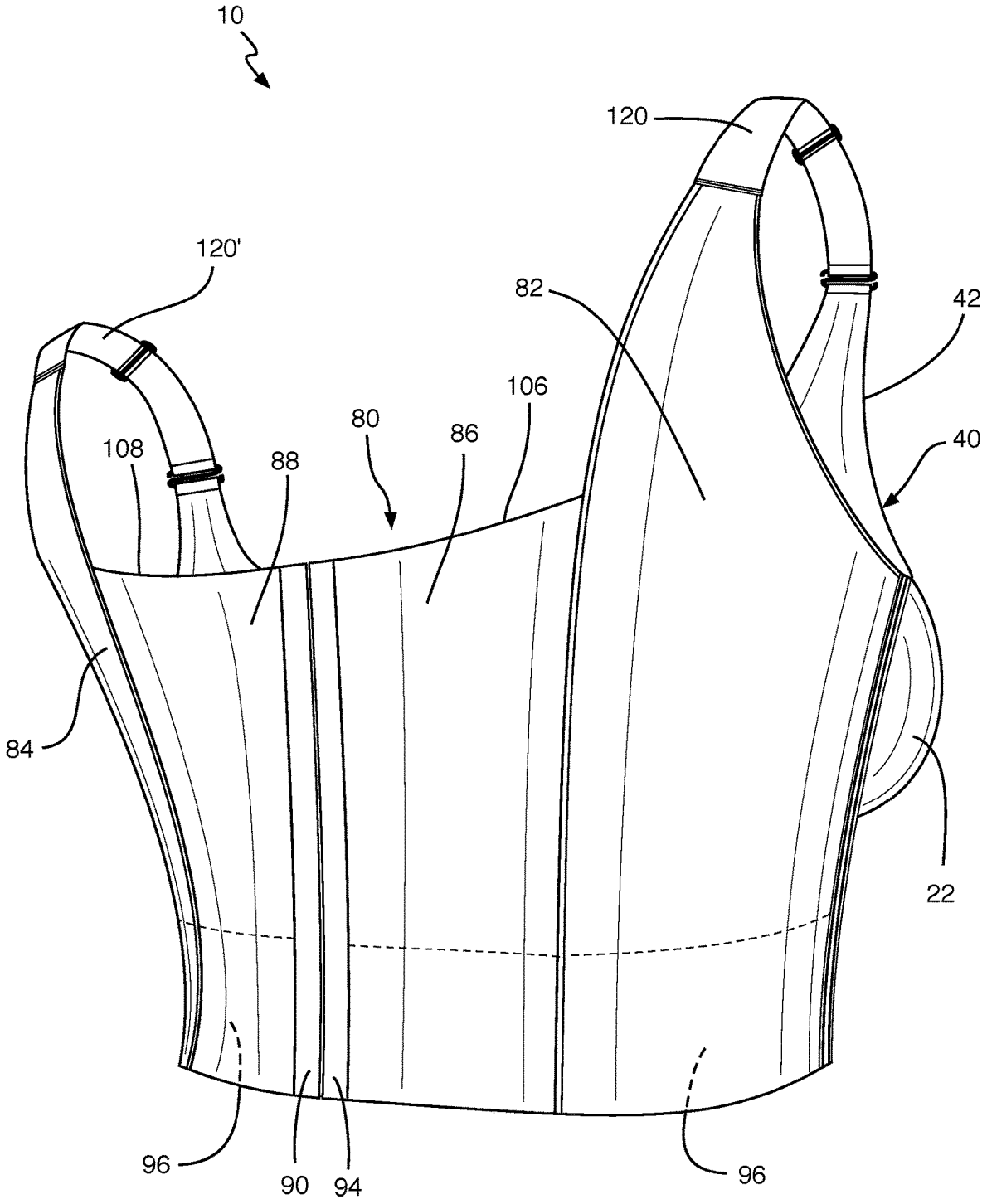
FIG. 2 is a rear isometric view of the present invention.

As seen in FIGS. 1 and 2, cup section 20 comprises first cup 22 and second cup 22' to receive respective breasts of a user. Present invention 10 is made of a knitted stretch fabric that shapes and smoothes a back and underarms of the user. In a preferred embodiment, present invention 10 is made of a Powernet material. First and second control panels 40, and 40' seen in FIG. 3A, contain flesh under the user's arms, eliminating any overhang of the flesh. In addition, first and second control panels 40 and 40' keep the user's breasts centered and balanced. Back panel assembly 80 comprises a high back design. The high back design shapes the user's back.

Figure 3A:
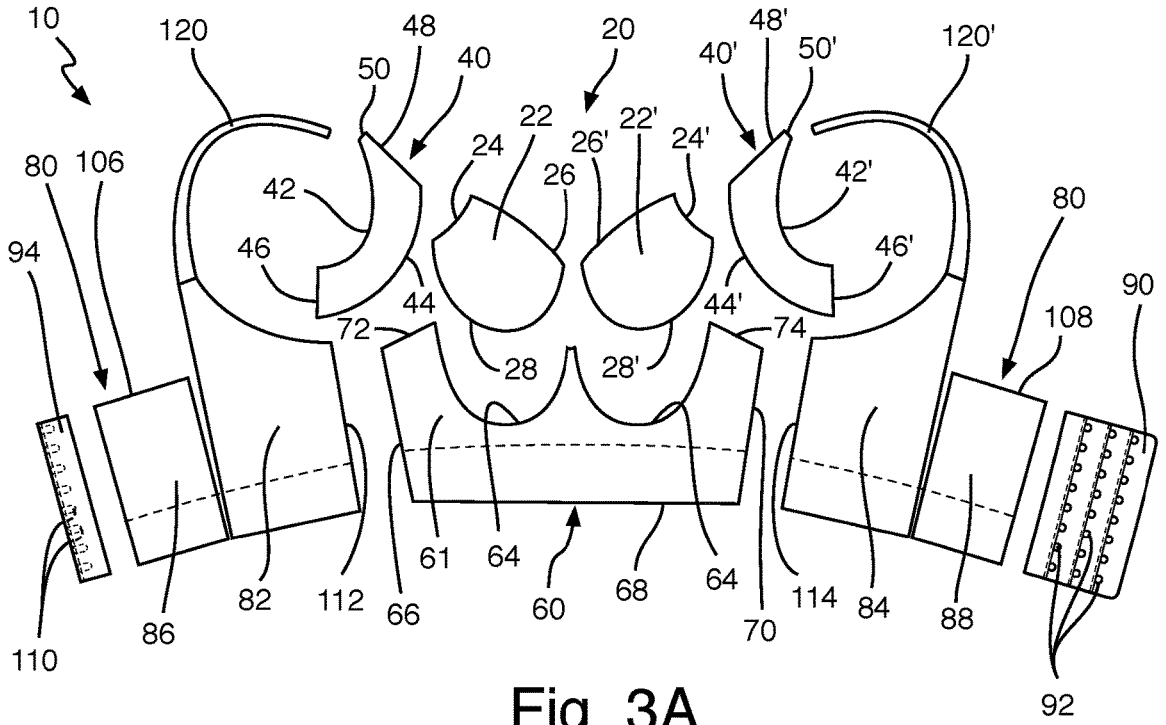
FIG. 3A is an exploded view of an exterior side of the present invention.
Figure 3B:
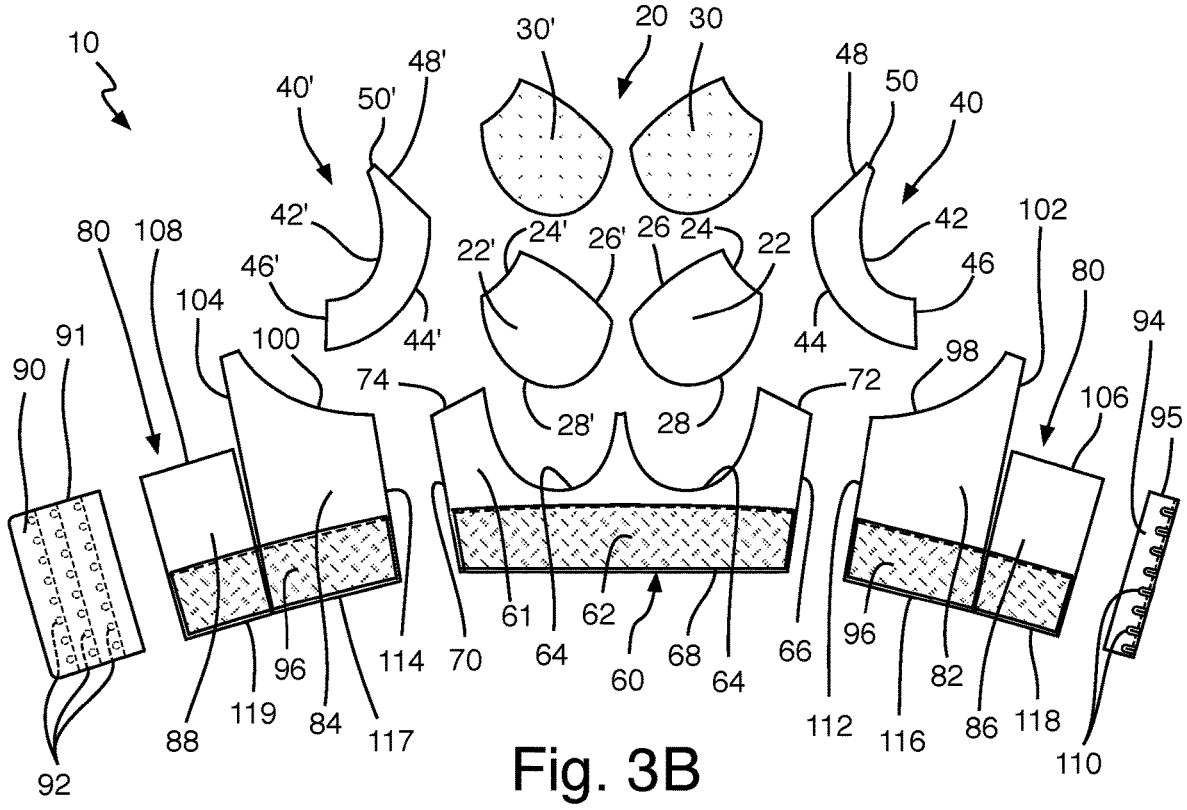
FIG. 3B is an exploded view of an interior side of the present invention.

As seen in FIGS. 3A and 3B, first cup 22 comprises lateral edge 24, neckline 26, and cup base 28. Second cup 22' comprises lateral edge 24', neckline 26', and cup base 28'. Cup section 20 further comprises first and second padding inserts 30 and 30' respectively. First cup 22 and second cup 22' receive first padding inserts 30 and second padding inserts 30' respectively.

First control panel 40 comprises underarm edge 42, lower edge 44, back edge 46, neckline edge 48, and strap edge 50. Second control panel 40' comprises underarm edge 42', lower edge 44', back edge 46', neckline edge 48', and strap edge 50'.

Bottom band 60 comprises band 61 having elastic strip 62. Band 61 is defined by first and second cup edges 64, first band lateral edge 66 and second band lateral edge 70, bottom edge 68, first upper edge 72, and second upper edge 74. Elastic strip 62 extends from and along bottom edge 68 from first band lateral edge 66 to second band lateral edge 70.

Back panel assembly 80 comprises first panel 82, second panel 84, first wing 86, second wing 88, and back elastic strips 96.

First panel 82 comprises band upper edge 98, back panel lateral edge 102, interior edge 112, and panel bottom edge 116. Second panel 84 comprises band upper edge 100, back panel lateral edge 104, interior edge 114, and panel bottom edge 117.

First wing 86 comprises first wing upper edge 106 and first wing bottom edge 118. Second wing 88 comprises second wing upper edge 108 and second wing bottom edge 119.

First control panel 40 and second control panel 40' are attached to first cup 22 and second cup 22' respectively, bottom band 60, and back panel assembly 80.

First control panel 40 is attached to first cup 22, whereby lower edge 44 is attached to lateral edge 24. First control panel 40 attaches to bottom band 60, whereby lower edge 44 is attached to respective upper edge 72. First control panel 40 is attached to back panel assembly 80 whereby back edge 46 attaches to respective interior edge 112. Underarm edge 42 aligns with respective band upper edge 98.

Second control panel 40' is attached to second cup 22', whereby lower edge 44' is attached to lateral edge 24'.

Second control panel 40' attaches to bottom band 60, whereby lower edge 44' is attached to respective upper edge 74. Second control panel 40' is attached to back panel assembly 80, whereby back edge 46' attaches to respective interior edge 114. Underarm edge 42' aligns with respective band upper edge 100.

Figure 4A:
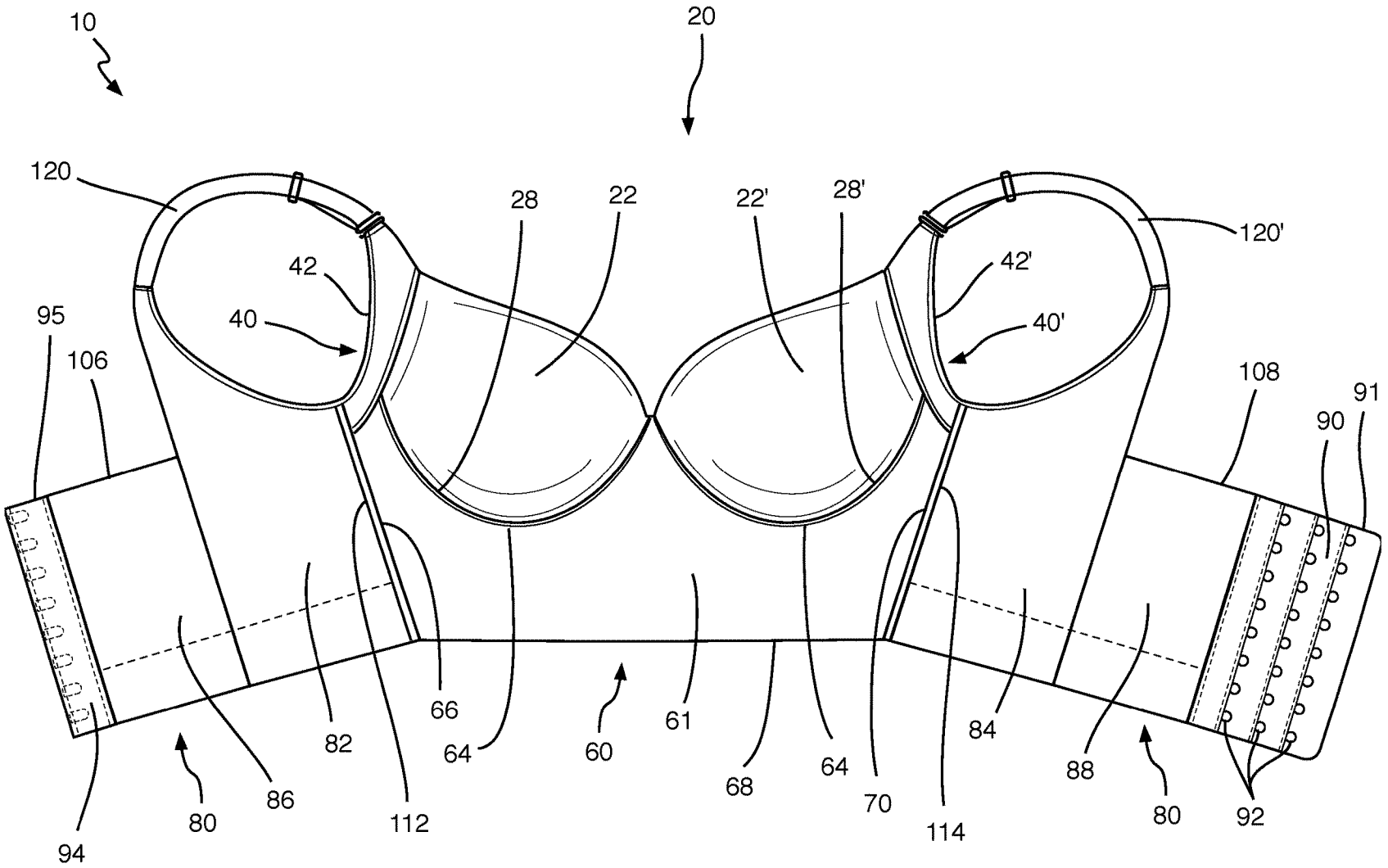
FIG. 4A is a front view of the exterior side of the present invention.
Figure 4B:
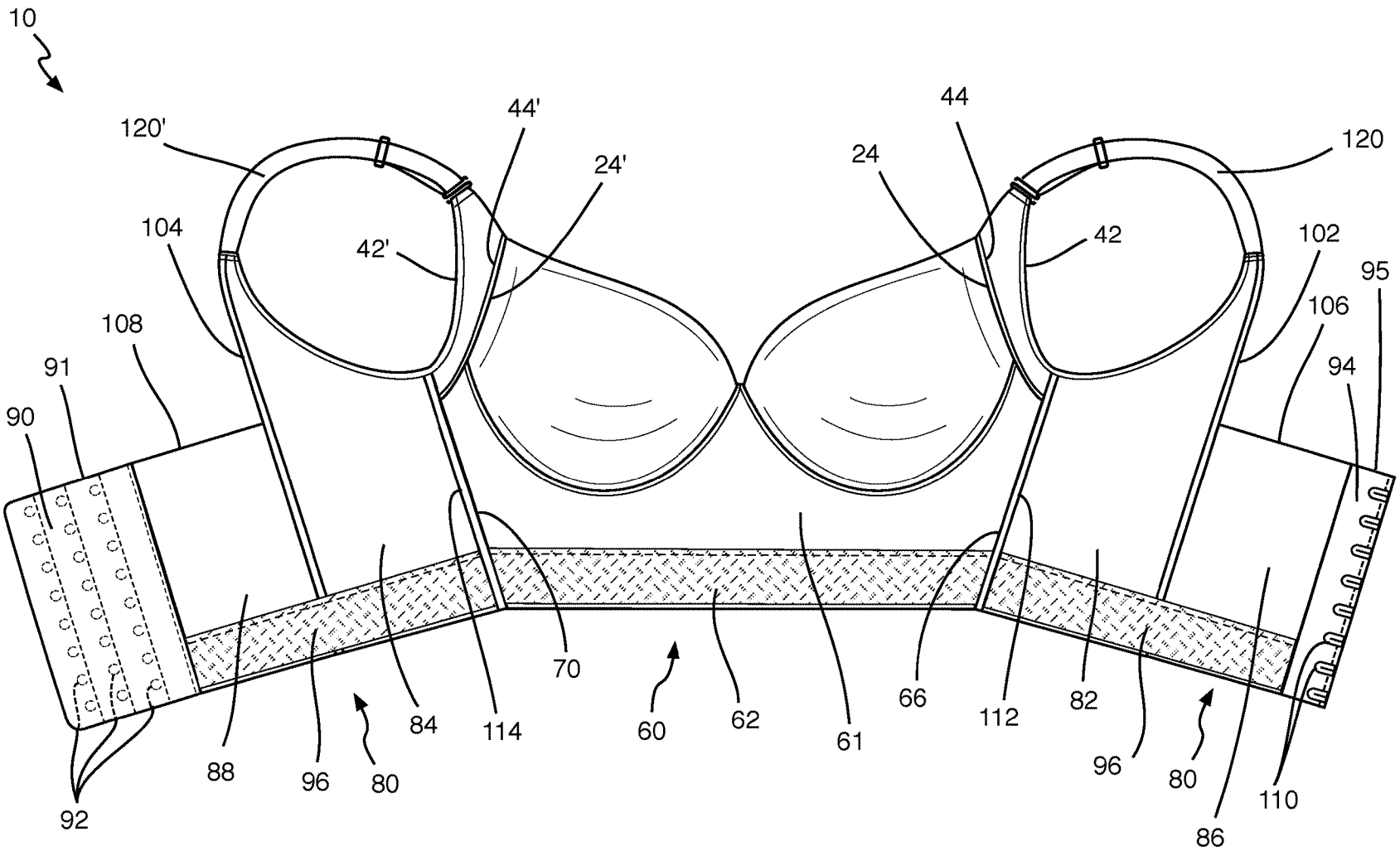
FIG. 4B is a front view of the interior side of the present invention.

As seen in FIGS. 4A and 4B, first cup 22 and second cup 22' are attached to bottom band 60, whereby first and second cup edges 64 receive first and second cup bases 28 and 28' respectively.

First and second straps 120 and 120' extend from first and second control panels 40 and 40' respectively to first and second panels 82 and 84 respectively.

Bottom band 60 is attached to back panel assembly 80, whereby first band lateral edge 66 attaches to first interior edge 112, second band lateral edge 70 attaches to second interior edge 114, and elastic strip 62 and back elastic strips 96 relatively align.

Back panel assembly 80 further comprises eyelet band 90 having a plurality of eyelets 92, and hook strip 94 having a plurality of hooks 110. In a preferred embodiment, there are three rows of eyelets 92.

Eyelet band 90 is attached to second wing 88, whereby eyelet band top edge 91 aligns with second wing upper edge 108. Hook strip 94 is attached to first wing 86, whereby hook strip top edge 95 aligns with first wing upper edge 106.

First panel 82 is attached to first wing 86, whereby a section of first back panel lateral edge 102 extends from first wing upper edge 106 defining an L-shape.

Second panel 84 is attached to second wing 88, whereby a section of second back panel lateral edge 104 extends from second wing upper edge 108 defining an L-shape.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A brassiere comprising:

A) a cup section having first and second cups, each of said first and second cups comprising a lateral edge, a neck line, and a cup base, said cup section further comprising first and second padding inserts;

B) first and second control panels, said first and second control panels each comprising an underarm edge, a lower edge, a back edge, a neckline edge, and a strap edge, wherein said first and second control panels are configured to hold a wearer's flesh and eliminate overhang of said wearer's flesh;

C) a bottom band comprising a band having an elastic strip, wherein said bottom band is defined by first and second cup edges, first and second band lateral edges, a bottom edge, and upper edges, wherein said elastic strip extends from said bottom edge;

D) a back panel assembly comprising first and second panels, first and second wings, and back elastic strips, said back panel assembly further comprising an eyelet band having a plurality of eyelets and a hook strip having a plurality of hooks, said first and second wings comprising first and second wing upper edges, respectively, and first and second wing bottom edges, respectively, said hook strip is attached to said first wing and said eyelet band is attached to said second wing, wherein a top edge of said hook strip aligns with, and forms a first continuous straight line with, said first wing upper edge, and a top edge of said eyelet band aligns with, and forms a second continuous straight line with, said second wing upper edge, said back panel assembly comprises a high back design, said first and second panels each comprise a band upper edge, a back panel lateral edge, an interior edge, and a panel bottom edge, said first panel is attached to said first wing, wherein a section of said first back panel lateral edge extends from said first wing upper edge defining a first L-shape, said second panel is attached to said second wing, wherein a section of said second back panel lateral edge extends from said second wing upper edge defining a second L-shape; and E) first and second straps, whereby wherein, said brassiere is made of a knitted stretch fabric.

2. The brassiere set forth in claim 1, wherein said first and second control panels are attached to said bottom band; wherein each of said lower edges are attached to a respective said upper edge.

3. The brassiere set forth in claim 1, wherein said first and second control panels are attached to said back panel assembly; wherein each of said back edges are attached to a respective said interior edge.

4. The brassiere set forth in claim 1, wherein each of said underarm edges aligns with a respective said band upper edge.

5. The brassiere set forth in claim 1, wherein said first and second cups are attached to said bottom band; wherein said first and second cup edges receive said first and second cup bases, respectively.

6. The brassiere set forth in claim 1, wherein said first and second straps extend from said first and second control panels, respectively, to said first and second panels respectively.

7. The brassiere set forth in claim 1, wherein said bottom band is attached to said back panel assembly, wherein said elastic strip and said back elastic strips align.

* * * * *